US007401407B2

(12) United States Patent
Miyasaka

(10) Patent No.: US 7,401,407 B2
(45) Date of Patent: Jul. 22, 2008

(54) ELECTRIC ROTARY SHAVER

(75) Inventor: Toshihide Miyasaka, Matsumoto (JP)

(73) Assignee: Izumi Products Company, Nagano (JP)

( * ) Notice: Subject to any disclaimer, the term of this patent is extended or adjusted under 35 U.S.C. 154(b) by 0 days.

(21) Appl. No.: 10/834,420

(22) Filed: Apr. 29, 2004

(65) Prior Publication Data

US 2004/0221454 A1 Nov. 11, 2004

(30) Foreign Application Priority Data

May 6, 2003 (JP) ..... 2003-127991

(51) Int. Cl.
*B26B 19/38* (2006.01)
*B26B 19/44* (2006.01)

(52) U.S. Cl. ..... 30/43.6; 30/41; 30/41.5

(58) Field of Classification Search ..... 30/43.6, 30/41, 41.5, 29.5, 34.05, 43.4, 43.5; 408/18, 408/56

See application file for complete search history.

(56) References Cited

U.S. PATENT DOCUMENTS

| | | | | | |
|---|---|---|---|---|---|
| 2,899,743 | A * | 8/1959 | Heuvel | 30/34.05 |
| 3,054,179 | A * | 9/1962 | Reiser et al. | 30/29.5 |
| 3,369,294 | A * | 2/1968 | Shaw et al. | 30/41.5 |
| 4,363,169 | A * | 12/1982 | Nasu et al. | 30/41 |
| 4,442,596 | A * | 4/1984 | Nasu et al. | 30/41.5 |
| 4,631,825 | A * | 12/1986 | Kuriyama et al. | 30/43.92 |
| 4,693,673 | A * | 9/1987 | Nee | 416/199 |
| 4,910,869 | A * | 3/1990 | Labrijn | 30/43.6 |
| 4,934,051 | A * | 6/1990 | Labrijn | 30/43.6 |
| 5,909,928 | A * | 6/1999 | Barish | 30/41.5 |
| 6,067,714 | A * | 5/2000 | Taylor et al. | 30/29.5 |
| 6,199,282 | B1 * | 3/2001 | Uchiyama et al. | 30/43.6 |
| 6,354,005 | B1 * | 3/2002 | Bosch | 30/43.6 |

FOREIGN PATENT DOCUMENTS

| | | |
|---|---|---|
| CN | 2264640 | 10/1997 |
| EP | 54070155 | 6/1979 |
| EP | 06178876 | 6/1994 |
| EP | 1 179 399 A2 | 2/2002 |
| GB | 979 183 | 1/1965 |
| JP | 51 094348 | 8/1976 |
| JP | 55 158088 | 12/1980 |
| JP | 7-124347 | 5/1995 |
| JP | 9-122363 | 5/1997 |
| JP | 2001-198367 | 7/2001 |

* cited by examiner

*Primary Examiner*—Boyer D. Ashley
*Assistant Examiner*—Edward Landrum
(74) *Attorney, Agent, or Firm*—William L. Androlia; H. Henry Koda

(57) ABSTRACT

An electric rotary shaver, in which the cutter head that includes outer and inner cutters is washable while the inner cutter(s) is being rotationally driven, including agitating vanes that agitate the liquid in which the cutter head is immersed and discharge shaving debris out of the cutter head by generating a flow of the liquid. The agitating vanes are provided on a drive shaft(s) that engages with and rotates the inner cutter(s) and rotationally drives the inner cutter(s).

7 Claims, 8 Drawing Sheets

ELECTRIC ROTARY SHAVER

BACKGROUND OF THE INVENTION

1. Field of the Invention

The present invention relates to an electric rotary shaver and more particularly to an electric rotary shaver that has a washable cutter head.

2. Prior Art

In one type of electric shaver, a cutter head, which includes an outer cutter and an inner cutter, and a shaving debris accommodating section, which is inside the cutter head, are provided so that the cutter head and the shaving debris accommodating section can be cleaned or washed using a water rinse or cleaning liquid.

Such washable electric shaver is disclosed in, for instance, Japanese Patent Application Laid-Open (Kokai) Nos. 7-124347, 9-122363 and 2001-198367.

There are substantially two methods for washing electric shavers. In one method, the cutter head is removed from the main body of the electric shaver, and washing is performed with its power turned off. In another method, washing is performed with the cutter head mounted on the main body of the shaver and the power is turned on.

When washing is performed with the cutter head removed from the main body of the electric shaver, shaving debris is rinsed away using flowing water or the like. However, when washing is performed with the cutter head mounted on the main body of the electric shaver, it is necessary to perform washing in a state in which the discharge of shaving debris to the outside of the cutter head can be done easily.

FIG. 5 shows one example of an electric rotary shaver that has three rotary cutters.

In this shaver, a cutter cradle 12 is provided inside upper portion of the main body 10 of the shaver, and a cutter head 20 is detachably mounted on the cutter cradle 12.

The cutter cradle 12 is in a recessed shape so as to accommodate shaving debris. Three drive shafts 14 that drive or rotate three inner cutters are disposed so that these drive shafts protrude from the inside bottom surface of the cutter cradle 12. The cutter head 12 includes three outer cutters 22 and three inner cutters (not shown) that respectively make sliding contact with the outer cutters. The drive shafts 14 that protrude from the bottom of the cutter cradle 12 respectively engage with the inner cutters when the cutter head 20 is mounted on the main body 10, and these drive shafts 14 rotationally drive the inner cutters when the power of the electric shaver is turned on.

Accordingly, when washing is performed with the cutter head 20 removed from the main body 10, shaving debris that has accumulated in the cutter cradle 12 can easily be discharged and washed away by removing the cutter head 20 from the main body 10 of the electric shaver as shown in FIG. 5.

FIG. 6 shows the manner of washing the electric shaver with the cutter head on and while the power is on.

The reference numeral 50 is a cleaning vessel filled with a cleaning liquid 52. The cutter head 20 is set to face down and is immersed in the cleaning liquid in the cleaning vessel 50; then, the shaver is switched on and cleaning is performed while the electric shaver is being driven.

The space between the inside bottom of the cutter cradle 12 and the cutter head 20 constitutes a space that accommodates shaving debris. As a result of the action of the flow of cleaning liquid that is generated by the rotation of the inner cutters 23 and drive shafts 14, the shaving debris that has been in this space is discharged into the cleaning vessel 50 via slit-form openings (or hair introducing apertures) formed in the outer cutters 22.

However, as seen from FIG. 6, when the washing is performed by rotating the inner cutters 23 in the cleaning liquid 52 in the cleaning vessel 50, though the inner cutters 23 and the areas near the inner cutters 23 can be washed by agitating the cleaning liquid 52 in the vicinity of the inner cutters 23, shaving debris cannot be effectively discharged to the outside of the space in which such shaving debris accommodates. Accordingly, after the cutter head 20 has been cleaned in the cleaning vessel 50, it is further necessary to remove the cutter head 20 from the main body 10 and clean the cutter cradle 12 and other parts using a brush or the like.

SUMMARY OF THE INVENTION

The present invention is to solve the problems described above.

The object of the present invention is to provide an electric rotary shaver that efficiently discharges shaving debris by means of a cleaning operation that uses a water rinse or cleaning liquid in a state in which the electric shaver is being driven with the cutter head mounted on the main body of the electric shaver, thus making it possible to perform an easy cleaning operation and maintain the electric shaver clean.

The above object is accomplished by a unique structure of the present invention for an electric rotary shaver in which a cutter head is disposed so that washing thereof can be done while the inner cutter(s) in the cutter head is being rotationally driven; and in the present invention, agitating vanes are formed on the shaver's drive shaft(s) that engages with and rotationally drives the inner cutter(s), so that the agitating vanes agitate the liquid in which the cutter head is immersed and discharge the shaving debris out of the cutter head.

In this structure, the agitating vanes are disposed in an orientation that causes the liquid in which the cutter head is immersed to flow from the inside of the cutter head to the outside of the cutter head.

In addition, the agitating vanes are disposed in close proximity to the bottom of an accommodating section of the shaver that accommodates shaving debris, so that the shaving debris adhering to the bottom and side wall surfaces of the accommodating section is scraped off and removed by means of the flow of the cleaning liquid, so that the shaving debris accumulated inside the cutter head is efficiently discharged.

In the structure of the electric rotary shaver of the present invention:

- the cutter head includes an outer cutter frame, a cutter retaining plate detachably attached to the outer cutter frame, an inner cutters) provided on the cutter retaining plate, and an outer cutter(s) supported in the outer cutter frame via the inner cutter(s);
- a cutter cradle is provided in the top portion of the main body of the electric shaver in such a manner that the cutter head is detachable with respect to the cutter cradle; and
- the drive shaft(s) is disposed so as to protrude from the bottom of the cutter cradle in a water-tight manner with respect to the main body of the electric shaver.

Furthermore, in the present invention, the drive shaft(s) is comprised of an engagement shaft and a paddle body; and the engagement shaft engages with the inner cutter when the cutter head is mounted on the cutter cradle, thus letting the inner cutter rotate, and the paddle body has the agitating vanes on its outer surface and is rotated as a unit with the engagement shaft.

DETAILED DESCRIPTION OF THE INVENTION

Preferred embodiments of the electric rotary shaver of the present invention will be described in detail below.

The characterizing structure of the electric rotary shaver of the present invention lies in the drive shafts 14 which are disposed to protrude from the bottom 12*a* of the cutter cradle 12.

Figure 1:
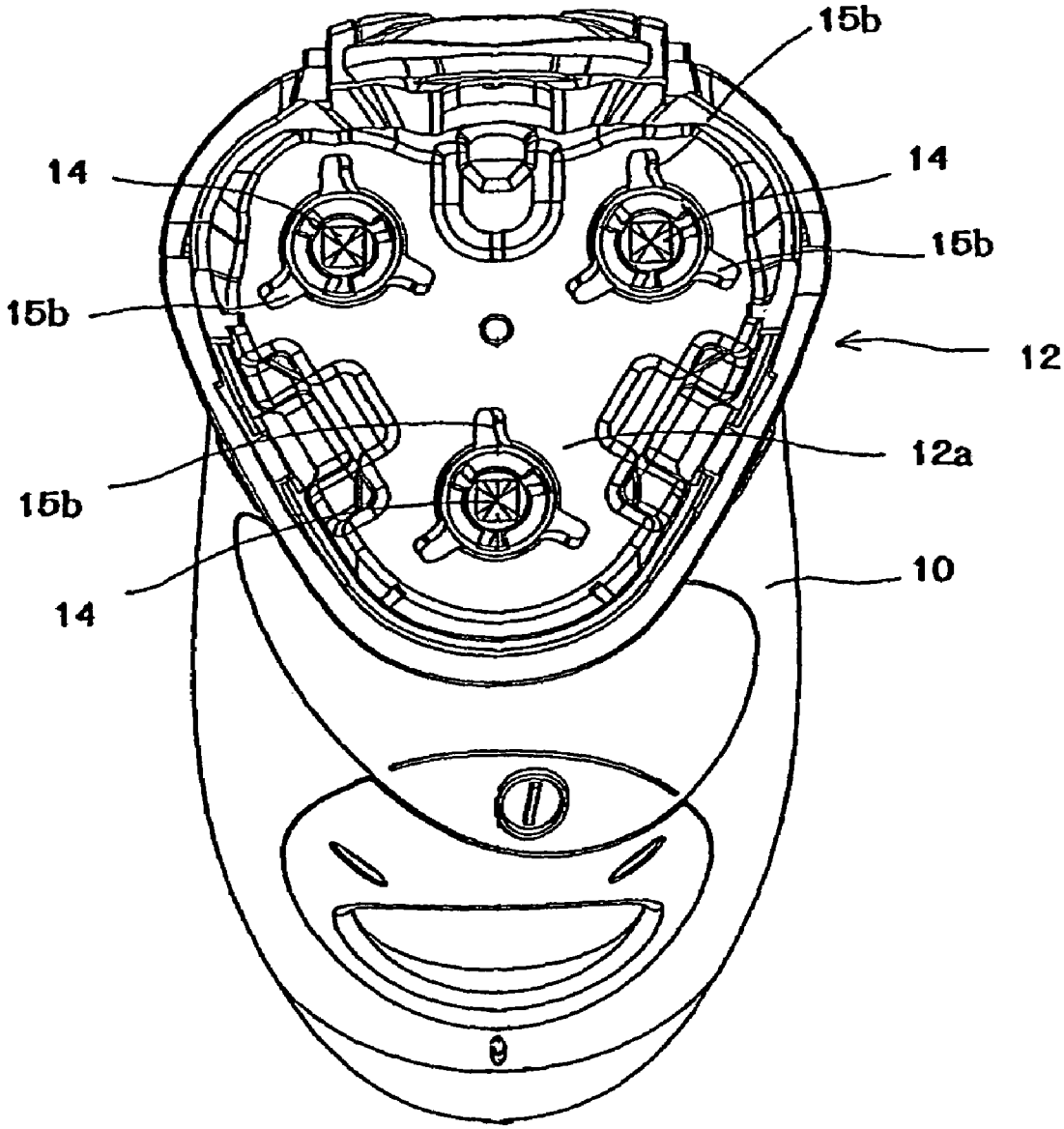
FIG. 1 shows the electric rotary shaver of the present invention seen substantially from above the cutter cradle.

As seen from FIG. 1, the cutter cradle 12 is in substantially a triangular shape with its corners rounded, and three drive shafts 14 are respectively disposed in positions that correspond to the vertices of the equilateral triangle.

The drive shafts 14 are connected to a motor (not shown) installed inside the main body 10 of the electric shaver. When the motor is switched on by the operation of a switch, the drive shafts 14 are rotationally driven about their axes.

Figure 2A:
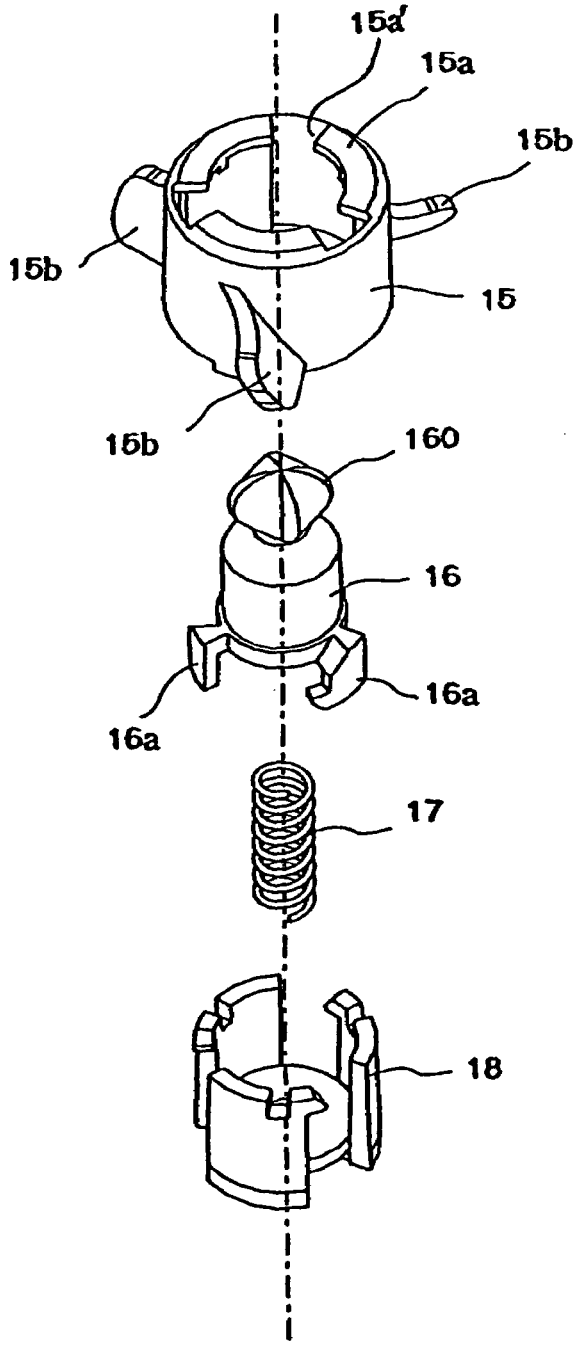
FIG. 2A is a perspective view of one of the drive shafts of the electric rotary shaver of the present invention, the drive shaft being disassembled.
Figure 2B:
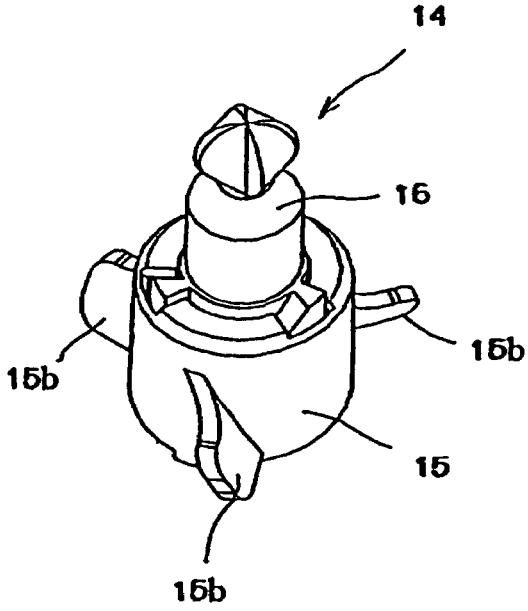
FIG. 2B is a perspective view of the drive shaft assembled.

FIG. 2A shows the elements of one of the drive shafts 14, all having the same structure; and FIG. 2B shows the drive shaft 14 assembled. In the shown embodiment, as seen from FIG. 2A, each drive shaft 14 comprises a paddle body 15, an engagement shaft 16, a cutter push-up spring 17 and a drive shaft bearing 18.

The paddle body 15 is cylindrical in shape, and an engaging portion 15*a* is disposed on the upper portion of the paddle body 15. The engaging portion 15*a* engages with the engagement shaft 16 and allows the paddle body 15 to rotate as a unit with the engagement shaft 16 about its axis. The engaging portion 15*a* protrudes inward in the form of an eave. The reason for this shape of the engaging portion 15*a* is to allow the engagement shaft 16 to be movable in the axial direction and to prevent the engagement shaft 16 from slipping out of the paddle body 15. The paddle body 15 is further formed with three cut-outs 15*a*' in the engaging portion 15*a* at equal intervals in the circumferential direction. These cut-outs 15*a*' are provided so as to allow the engagement shaft 16 to engage with the cut-outs and rotate the paddle body 15 as a unit with the engagement shaft 16 about their axes. The engagement shaft 16 is movable in the axial direction relative to the paddle body 15; and when the engagement shaft 16 is moved to protrude (or moved to a position that protrudes from the paddle body 15) the engagement shaft 16 engages with the engaging portion 15*a* of paddle body 15, so that the engagement shaft 16 and paddle body 15 can be rotated as a unit about their axes.

The paddle body 15 is formed with three agitating vanes 15*b* at circumferentially equal intervals on its cylindrical outer surface. The agitating vanes 15*b*, when the electric shaver is cleaned using water or a cleaning liquid, generate a positive flow of liquid from the internal space in which shaving debris is accommodated toward the outside of the cutter head 20 by the rotation of each corresponding drive shaft 14. The agitating vanes 15*b* are shaped so that they can generate such an outward-oriented flow of liquid when the drive shaft (s) 14 is rotated.

In the shown embodiment, the agitating vanes 15*b* are formed near the base (lower) portion (i.e., the side closer to the bottom of the cutter cradle 12) of the paddle body 15. This arrangement is made in order to generate a flow of liquid from the area closer to the bottom of the cutter cradle 12, so that even shaving debris adhering to the bottom surface of the cutter cradle 12 is easily removed.

Though in the shown embodiment three agitating vanes 15*b* are disposed at equal intervals on the outer circumferential surface of the cylindrical paddle body 15, the number of agitating vanes 15*b* that are disposed can be different. They can be two or more than three.

The engagement shaft 16 is substantially a slender shaft, and it has at its tip end portion an engaging portion 160 that engages with a corresponding inner cutter that is in the cutter head 20, and engaging portions 16*a* that engage with the engaging portion 15*a* of the paddle body 15 are formed near the base (lower) portion of this shaft 16. As shown in FIG. 2B, the engagement shaft 16 is inserted in the paddle body 15 from beneath the paddle body 15.

A cutter push-up spring 17 is provided so as to contact the undersurface of the engagement shaft 16 when the drive shaft 14 is connected to and assembled in the main body of the electric shaver. The cutter push-up spring 17 supports the engagement shaft 16 so that the engagement shaft 16 is constantly urged in the protruding direction (upward in FIG. 2A). The inner cutter and outer cutter are supported in a manner that they can "float" (to make axial motions) by the engagement shaft 16 via this cutter push-up spring 17.

The drive shaft bearing 18 receives the engagement shaft 16 therein and is inserted into the paddle body 15. The drive shaft bearing 18 and engagement shaft 16 are free to move in the axial direction and are axially rotatable as a unit. Since the engagement shaft 16 is supported in a floating state by the cutter push-up spring 17, the engagement shaft 16 is connected to a shaver driving mechanism that rotates the inner cutter regardless of the position in its axial direction. The drive shaft bearing 18 and engagement shaft 16 rotate as a unit about their axes regardless of the position in the axial direction, and a connection with the driving mechanism is thus maintained.

The drive shaft 14 is, as seen from FIG. 2B, obtained by assembling the above-described paddle body 15, engagement shaft 16, cutter push-up spring 17 and drive shaft bearing 18 into a single unit; and since the paddle body 15 is in the outermost position, the agitating vanes 15*b* protrude from the outer surface of the drive shaft 14. Thus, each one of the three drive shafts 14 has the agitating vanes 15*b*.

Figure 3:
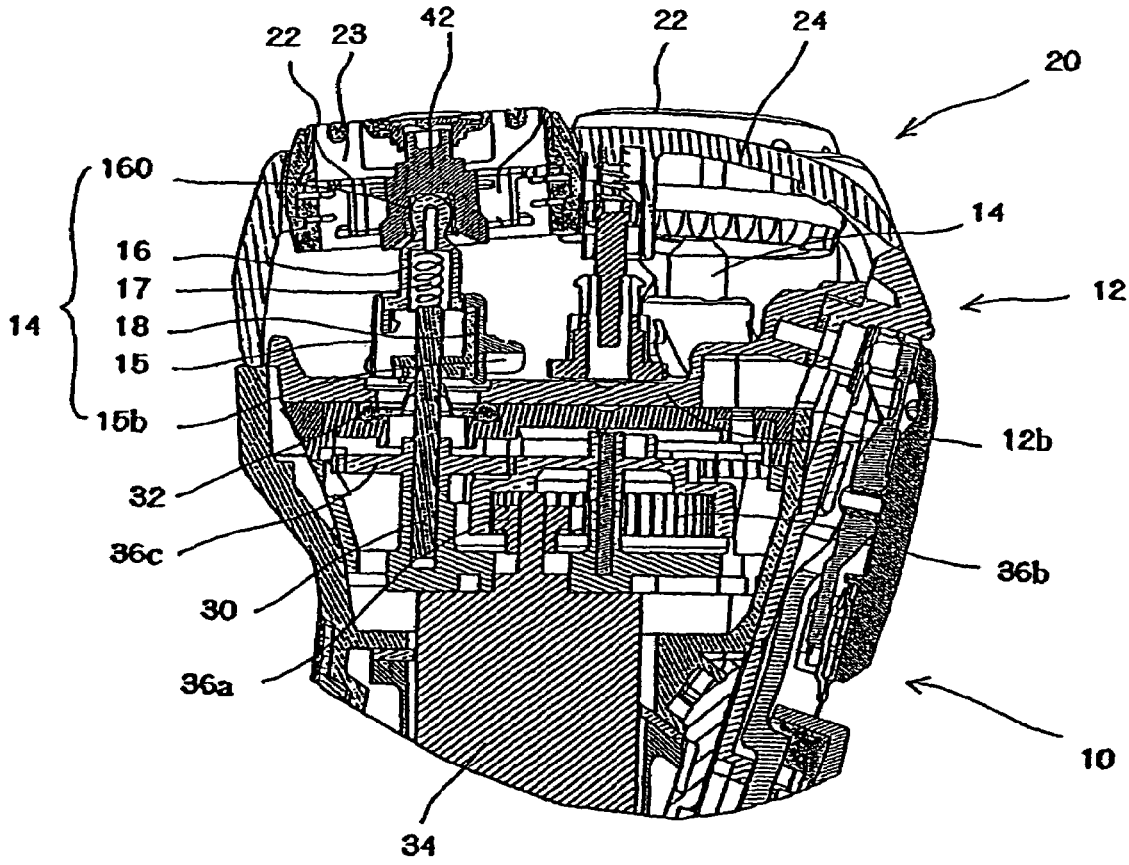
FIG. 3 shows, in vertical cross-section, the upper portion of the electric rotary shaver of the present invention, illustrating the internal structure.

FIG. 3 shows, in cross-section, the cutter head 20 that is mounted on the main body 10 of the electric shaver.

The reference numeral 12*b* is a bottom plate of the cutter cradle 12, and it partitions the cutter head 20 and the main body 10 of the electric shaver. Each one of the drive shafts 14 is connected to the driving mechanism of the shaver by fastening the drive shaft bearing 18 to the upper portion of each rotating shaft 30 that protrudes from a through-hole formed in the bottom plate 12*b*. In this through-hole in the bottom plate 12*b*, the space between the rotating shaft 30 and the bottom plate 12*b* is sealed in a water-tight manner by a sealing member 32 on the undersurface side of the bottom plate 12 (i.e., on the bottom surface of the bottom plate 12 that faces the main body 10).

The cutter push-up spring 17 of each drive shaft 14 is installed so that a resilient force thereof is applied between the tip end portion of the rotating shaft 30 and the inside surface of the engagement shaft 16. The engagement shaft 16 is thus supported in a floating manner with respect to the rotating shaft 30.

In FIG. 3, the reference numeral 34 is a motor which is installed in the main body 10 of the shaver. The motor 34 and each rotating shaft 30 are connected via a gear 36*a* fastened to the output shaft of the motor 34, a common gear 36*b*, and a gear 36*c* which is connected to each rotating shaft 30.

Furthermore, in the cutter head 20, inner cutters 23 and outer cutters 22 that are supported via the inner cutters 23 are provided by a cutter retaining plate (not shown in the drawing) which is detachably attached to the outer cutter frame 24 so that these cutters can swing and move in the axial direction and do not drop out of the cutter head 20.

The reference numeral 42 is an inner cutter base (only one inner cutter base shown) that is fastened to central portion of the inner cutter 23. The inner cutter base 42 is formed from a resin, and engaging recess with which the engaging portion 160 formed on the tip end of the engagement shaft 16 engages is formed in the undersurface (lower portion) of the inner cutter base 42.

When the cutter head 20 is mounted on the cutter cradle 12, the engaging portion 160 of each one of the three engagement shafts 16 engages with the engaging recess of each one of the three inner cutter bases 42 so that the inner cutters 23 can be rotated as a unit with the engagement shafts 16. The cutter surfaces of the inner cutters 23 constantly makes sliding contact with the inner surfaces of the corresponding outer cutters 22 via the engagement shafts 16 and inner cutter bases 42 by the resilient force of the cutter push-up springs 17, and thus the outer cutters 22 and inner cutters 23 are supported and pushed in a direction in which these cutters are urged toward the outside of outer cutter frame 24. Slit-form hair introduction openings (not shown) are formed in the outer cutters 22, and hair (whiskers) that is introduced into the outer cutters 22 through the hair introduction holes are cut by the outer cutters 22 and the rotating inner cutters 23.

As seen from the above, when the cutter head 20, which is detachable from the cutter cradle 12, is mounted on the cutter cradle 12, the inner cutters 23 in the cutter head 23 and the drive shafts 14 protruding from the bottom of the cutter cradle 12 engage with each other.

As shown in FIG. 3, an internal space is formed between the cutter head 20 and the cutter cradle 12 when the cutter head 20 is mounted on the cutter cradle 12, and this internal space forms an accommodating section that accommodates shaving debris.

In the above structure, the paddle bodies 15 of the drive shafts 14 are merely fitted over the drive shaft bearings 18 that rotate as a unit with the rotating shafts 30, and these paddle bodies 15 are rotated as a unit with the engagement shafts 16 only when engaged with the engagement shafts 16. In other words, the engagement shafts 16 are provided so as to be movable in the axial direction; and when the engagement shafts 16 are in the protruding positions, the engagement shafts 16 engage with the paddle bodies 15.

Figure 4:
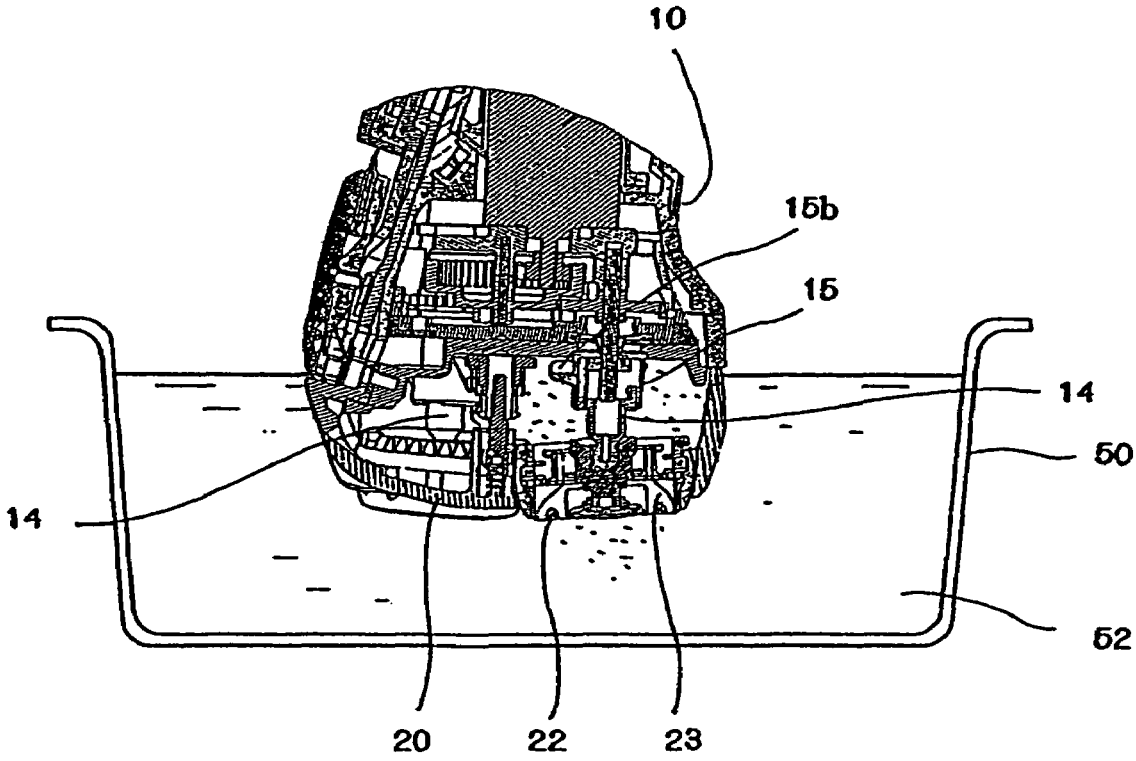
FIG. 4 shows the electric rotary shaver of the present invention being washed.

FIG. 4 shows the above-described electric rotary shaver being washed or washed using a cleaning liquid 52 in a cleaning vessel 50.

When the cutter head 20 is immersed in the cleaning liquid 52 and the switch of the electric shaver is turned on, the inner cutters 23 are rotated, and the paddle bodies 15 are rotated together with the rotation of the inner cutters 23. As a result of the rotation of the paddle bodies 15, the cleaning liquid is agitated inside the cutter head 20, and shaving debris that has accumulated inside the cutter head 20 is moved by the cleaning liquid and is discharged out of the cutter head 20 into the cleaning vessel 50 via the slit-form openings formed in the outer cutters 22.

The action of the agitating vanes 15*b* on the paddle bodies 15 is first of all an action that forcibly moves shaving debris by agitating the cleaning liquid inside the cutter head 20. As a result, the shaving debris can easily be discharged from the interior of the cutter head 20, and shaving debris adhering to the wall surfaces of the shaving debris accommodating section can easily be discharged.

In the shown embodiment, when the agitating vanes 15*b* rotate, the cleaning liquid that has entered into the cutter head 20 through the slit-form openings formed in the outer cutters 22, etc. flows from the inside to the outside of the cutter head 20; and with this flow of the cleaning liquid, shaving debris is discharged through the slit-form openings into the cleaning vessel 50. Thus, since the agitating vanes 15*b* are provided so as to cause the cleaning liquid to flow from the inside to the outside of the cutter head 20, shaving debris can be effectively discharged, accomplishing cleaning of the electric shaver.

As seen from the above, the electric rotary shaver of the present invention is cleaned by way of discharging the shaving debris that has accumulated inside the cutter head 20 out of the cutter head while the shaver is being driven; and in this electric rotary shaver, since the drive shafts 14 that rotationally drive the inner cutters 23 has the paddle bodies 15 that are formed with the agitating vanes 15*b*, the cleaning liquid is forcibly agitated by the rotating agitating vanes 15*b* that are rotated together with the drive shafts 14, and a flow of cleaning liquid is created inside the cutter head 20, and shaving debris is discharged out of the cutter head with the cleaning liquid.

In the shown embodiment, the paddle bodies 15 are provided on the drive shafts 14, and agitating vanes 15*b* are formed on the paddle bodies 15. However, as long as the cleaning liquid is agitated by the rotation of the drive shafts 14 so as to generate a flow of the cleaning liquid, the construction in which the agitating vanes are on the drive shafts 14 is not limited to the structure in which the vanes are formed on the paddle bodies 15.

Furthermore, the electric rotary shaver of the above-described embodiment has three sets of outer and inner cutters. However, as long as the shaver involved is an electric rotary shaver, there are no particular restrictions on the number of outer and inner cutters. The present invention is applicable to electric rotary shavers that include not only a single set of outer and inner cutters but also a plurality of sets of outer and inner cutters.

Furthermore, in the above-described embodiment, cleaning is performed by immersing the cutter head in a cleaning liquid. The electric shaver of the present invention can be cleaned, instead, by immersing the cutter head in flowing water in exactly the same manner as in the case where the shaver is cleaned using flowing water.

Furthermore, it is also possible to attach an ultrasonic apparatus to the cleaning vessel 50, so that the ultrasonic apparatus is operated when cleaning is performed by immersing the cutter head 20 in the cleaning liquid 52 so that shaving debris is stripped form the inside wall surfaces of the accommodating section by the action of ultrasound, thus discharging the shaving debris out of the cutter head 20 together with the cleaning liquid 52.

Figure 5:
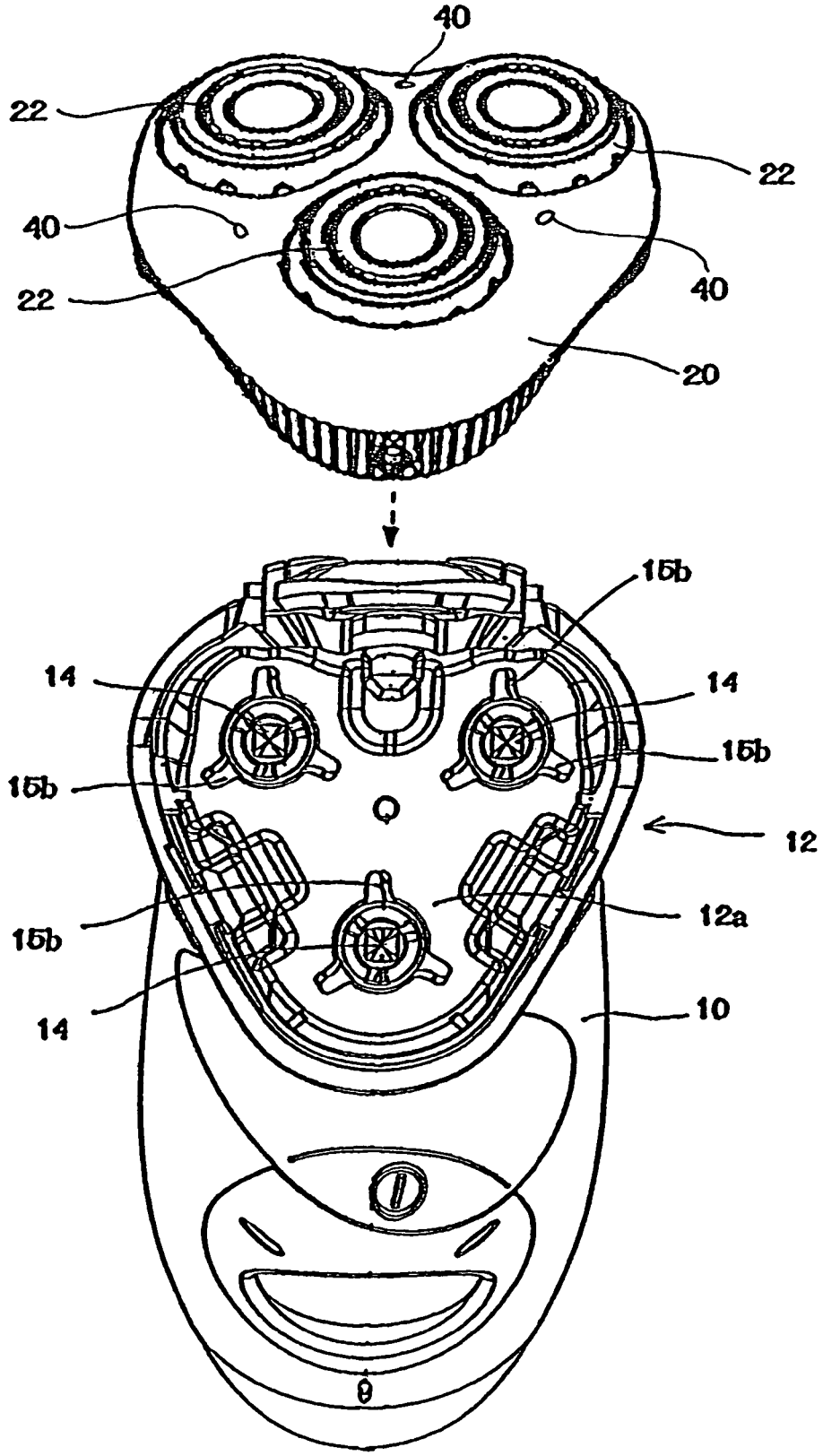
FIG. 5 shows another electric rotary shaver of the present invention that is formed with hair-debris releasing holes in the cutter head.

FIG. 5 shows the electric shaver of the present invention in which hair-debris releasing holes 40 are formed in the cutter head 20.

Figure 6:
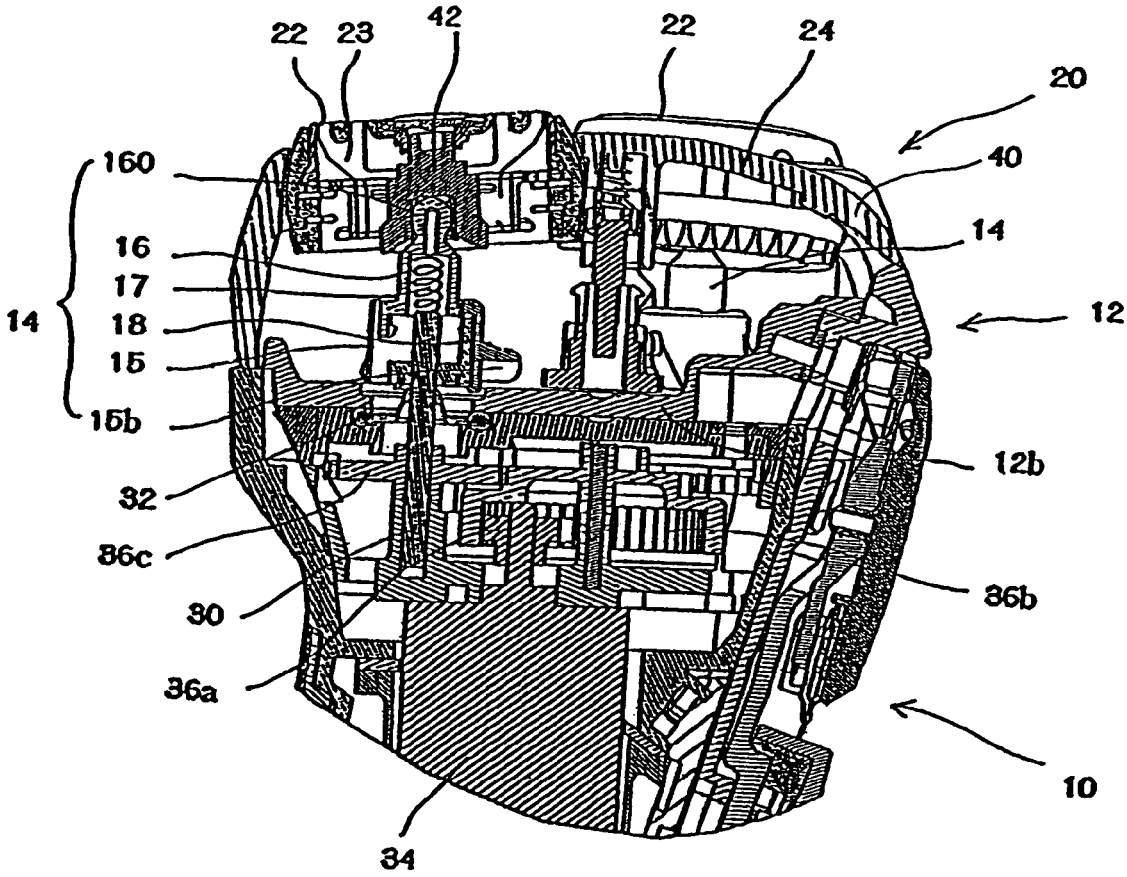
FIG. 6 shows, in vertical cross-section, the upper portion of the electric rotary shaver of FIG. 5.
Figure 7:
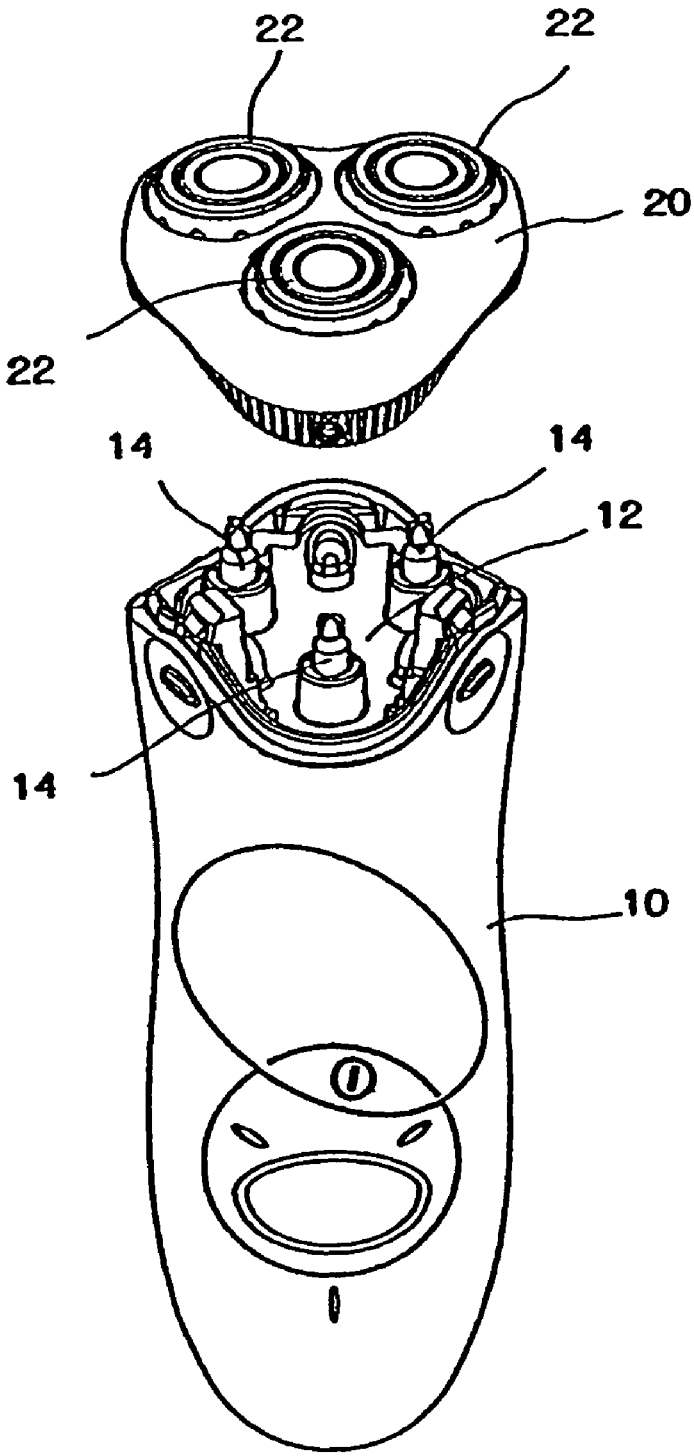
FIG. 7 PRIOR ART
FIG. 7 is a perspective view of the overall construction of a conventional electric rotary shaver with the cutter head dismounted.
Figure 8:
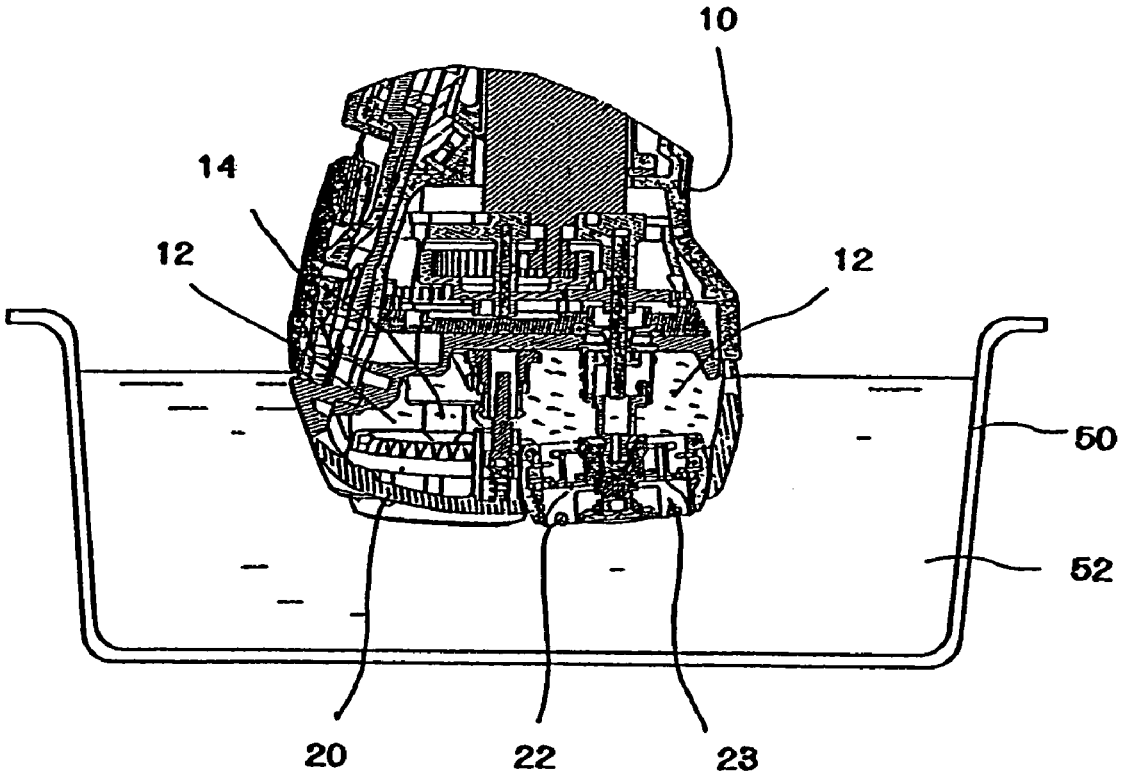
FIG. 8 PRIOR ART
FIG. 8 shows a conventional electric rotary shaver being washed.

More specifically, in this shaver of FIG. 5, holes 40 for releasing hair debris during cleaning of the cutter head 20 are opened in the upper portion of the cutter head 20 that is attached to the cutter cradle 12. The hair-debris releasing holes 40 are respectively provided so as to be between two outer cutters 22 (or outer cutter holes that receive the outer cutters 22) in the cutter head 20; and each of them is a through hole that is opened to penetrate the outer cutter frame 24 and has a diameter of, for instance, 2 mm as seen from FIG. 6.

When cleaning of the cutter head 20 is performed, long hair debris that is difficult to be washed out through the slit-form openings in the outer cutters can easily flow out of the hair-debris releasing holes 40 to the outside of the cutter head 20. Since water or cleaning liquid flows into and out of the cutter head 20 not only through the slit-form openings but also through the hair-debris releasing holes 40 during cleaning, water or liquid circulation inside the cutter head 20 is smoother than in the case in which water flows into and out of the cutter head 20 only through the slit-form openings, and thus cleaning is done further efficiently.

As seen from the above, in the electric rotary shaver of the present invention, agitating vanes are provided on a drive shaft(s) that rotationally drives the inner cutter(s), and cleaning liquid is agitated by the agitating vanes so as to generate a liquid flow. As a result, cleaning of the shaver (or the cutter head that includes outer and inner cutters) is performed by way of discharging shaving debris to the outside of the cutter head together with the liquid in which the cutter head is immersed. Consequently, an electric rotary shaver in which cleaning using water rinse or cleaning liquid is efficiently performed can be provided.

The invention claimed is:

1. An electric rotary shaver in which a cutter head includes a plurality of cutters each comprising an inner cutter and an outer cutter disposed so that cleaning thereof is performed while said inner cutter of each of said plurality of cutters is rotationally driven, said shaver further comprising a plurality of agitating vanes and a plurality of drive shafts, wherein at least one of said plurality of agitating vanes is provided on each of a plurality of drive shafts independently of said inner cutter, each of said drive shafts engage separate inner cutters of said plurality of cutters and rotationally drive said inner cutters of said plurality of cutters, said agitating vanes agitates a cleaning liquid in which said cutter head is immersed to cause said cleaning liquid to flow from the agitating vanes through the inner cutters and haircutting openings in said outer cutters from the inside to the outside of the cutter head to discharge substantially all shaving debris out of said haircutting openings in said outer cutters of said plurality of cutters.

2. The electric rotary shaver according to claim 1, wherein said agitating vanes are disposed in an orientation that causes said cleaning liquid in which said cutter bead is immersed to flow from an inside of said cutter head toward an outside of said cutter head through said openings in said outer cutter.

3. The electric rotary shaver according to claim 1, wherein said agitating vanes are disposed in close proximity to a bottom of an accommodating section that accommodates shaving debris.

4. The electric rotary shaver according to claim 1, wherein said cutter head is comprised of an outer cutter frame and said outer cutter of each of said plurality of cutters is supported in said outer cutter frame via said inner cutter of each of said plurality of cutters;

a cutter cradle is provided in a main body of said electric shaver so that said cutter head is detachably mounted thereon; and each of said plurality of drive shafts is disposed so as to protrude from a bottom of said cutter cradle in a water-tight manner with respect to said main body of said electric shaver.

5. The electric rotary shaver according to claim 4, wherein each of said plurality of drive shafts comprises:

an engagement shaft that engages with said inner cutter when said cutter head is mounted on said cutter cradle, thus rotating said inner cutter; and a paddle body that has said agitating vanes disposed on an outer surface thereof and is rotatable as a unit with said engagement shaft.

6. The electric rotary shaver according to claim 4 wherein said agitating vanes are provided below said inner cutters adjacent a base of said cutter cradle whereby shaving debris adhered to a bottom surface of said cutter cradle is removed during cleaning.

7. An electric rotary shaver according to claim 1 wherein said agitating vanes are provided below said inner cutters.

* * * * *